United States Patent [19]

Flesch et al.

[11] 4,146,369

[45] Mar. 27, 1979

[54] PROCESS FOR GAS PRODUCTION FROM SOLID FUELS

[75] Inventors: Wilhelm Flesch, Heidelberg; Karl-Heinz Brachthäuser, Ratingen; Walter Kaimann, Rietberg, all of Fed. Rep. of Germany

[73] Assignee: Projektierung Chemische Verfahrenstechnik GmbH, Fed. Rep. of Germany

[21] Appl. No.: 830,884

[22] Filed: Sep. 6, 1977

[30] Foreign Application Priority Data

Sep. 7, 1976 [DE] Fed. Rep. of Germany ..... 2640180

[51] Int. Cl.[2] ..... C10J 3/02; C10J 3/06; C10J 3/46; C10J 3/54

[52] U.S. Cl. ..... 48/201; 48/202; 48/203; 48/206; 48/210; 252/373

[58] Field of Search ..... 48/197 R, 201, 202, 48/203, 206, 210; 252/373

[56] References Cited

U.S. PATENT DOCUMENTS

| | | | |
|---|---|---|---|
| 901,232 | 10/1908 | Eldred | 48/203 |
| 1,840,649 | 1/1932 | Winkler et al. | 48/203 |
| 2,619,451 | 11/1952 | Ogorzaly et al. | 48/206 |
| 2,657,124 | 10/1953 | Gaucher | 48/202 |
| 2,689,786 | 9/1954 | Hubmann | 48/206 |
| 3,607,158 | 9/1971 | Dent et al. | 48/210 |
| 4,032,305 | 6/1977 | Squires | 48/197R |

*Primary Examiner*—S. Leon Bashore
*Assistant Examiner*—Peter F. Kratz
*Attorney, Agent, or Firm*—Holman & Stern

[57] ABSTRACT

A single reactor is used for gasifying solid fuels of a wide range of particle sizes without first comminuting the particles to a common size. The larger particles are gasified on a fixed bed, and the smaller ones are gasified on a fluidized bed. In the reactor, the fluidized bed is arranged above the fixed bed and gases rising from the fixed bed help to fluidize the fluidized bed. In addition, a dust gasification region can be provided above the fluidized bed.

9 Claims, 2 Drawing Figures

PROCESS FOR GAS PRODUCTION FROM SOLID FUELS

Figure 1:
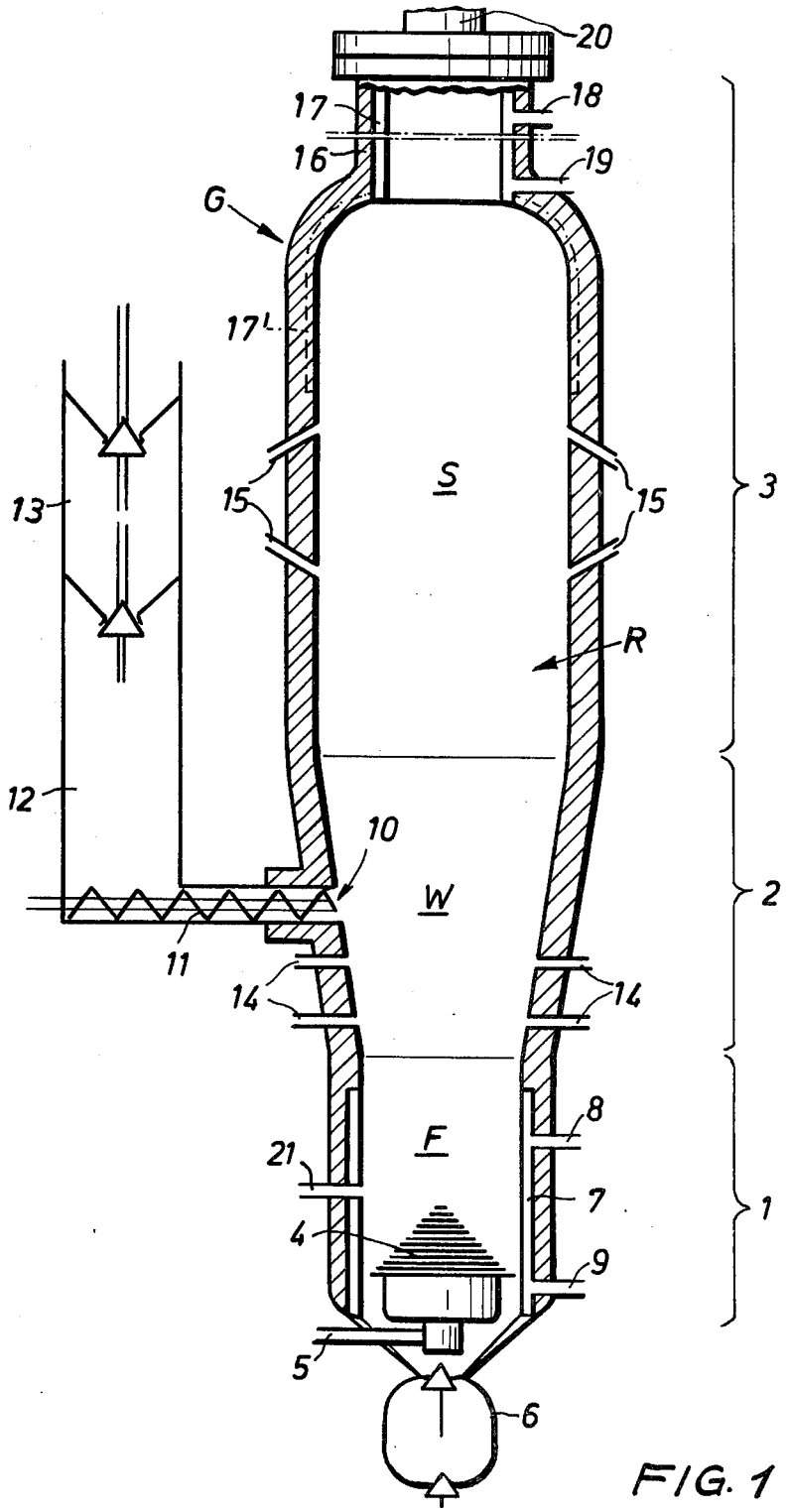

This invention relates to a process and device for producing gas from solid fuels by gasification in a reaction compartment while feeding gasification media.

Several processes and devices are known for gasifying coal or other solid fuels. The diversity of these processes derives from the varying state of the fuels used, and which determines the use of one or other process in any given case. A fixed bed generator is suitable for fuels in the form of lumps, whereas for granular fuels a different type of generator must be used. A still further device is used for gasifying feed material in the form of dust.

Each of these individual processes requires that the particle size distribution of the fuel lies within definite limits. Fixed bed generators are linked to narrow particle size ranges and generally require a particle size of over 10 mm. Any undersize impairs the operation of the process and emerges substantially ungasified. The so-called fluidised bed process operates with fuels having a particle size distribution of 0 to 10 mm. For pure dust gasification, the fuel must be so crushed that its particle size is less than 1 mm. A substantial disadvantage of all previous methods is that the particle size distribution of the fuel must be specially adapted to the respective process. For this, special and correspondingly expensive measures have to be employed.

According to the invention, there is provided a process for producing gas from solid fuels by gasification in a reaction compartment while feeding gasification media, characterised in that fuel with portions of different particle size is gasified in a single overall process, partly in a fluidised bed and partly in a stationary or quasi stationary bed.

The invention also extends to apparatus for producing gas from solid fuels.

According to a further development, dust portions of the fuel can be gasified simultaneously in a dust gasification region.

The combination according to the invention of gasification in a stationary or quasi stationary layer (fixed bed gasification) and fluidised bed gasification provides considerable advantages as compared with known processes. Fuel containing portions of lump and granular or even dust form can now be used as feed material for gasification without previous sorting. This therefore dispenses with costly pre-processing of the fuel to adapt its particle size to the requirements of a given process, as was previously indispensable. Furthermore, the process according to the invention raises the operational reliability of the fluidised bed gasification or dust gasification, as an additional fuel reserve is present in the overall process due to the associated fixed bed gasification.

Particular advantages derive from the process according to the invention in the gasification of bituminous brown or pit coal in the form of lumps. In the case of traditional gasification processes for such fuel, considerable expense is necessary to separate the low temperature carbonisation products from the product gas. In contrast, in the process according to the invention, low temperature carbonisation products from the stationary bed in which the lumpy portion of the fuel is degasified and gasified enter the subsequent incandescent fluidised bed to be cracked at the surface of the granular fuel portion, and the solid low temperature carbonisation products (cracked residues) are gasified therewith, so that only the required product gas and fine gasification residues containing ash leave the reactor. Thus in the process according to the invention, in addition to solid fuels, gaseous and/or liquid fuels such as oils, oil residues, tar from low temperature carbonisation or the like can be fed into the reaction compartment and also gasified therein. If a fuel gas is to be produced instead of synthesis gas, the process temperature may be kept lower.

The fuel is fed to the process desirably in the region of the fluidised bed gasification. The lumpy fuel portions then sink into the stationary gasification bed (fixed bed), and are gasified in counter current with the injected gasification media, whereas the granular portion is gasified in the fluidised bed. Dust portions of the fuel rise into a region above the fluidised bed and are gasified therein. The extent of gasification in the stationary bed is in accordance with the proportion of lumpy material in the total fuel. By choosing the relative quantities and mixture ratio of the gasification medium for the stationary bed, the development of the process is influenced and can be kept under control.

Gasification and degasification products formed in the stationary bed are added to or take the place of a portion of the gasification and fluidisation media injected directly into the fluidised bed.

In a further advantageous development of the process, in addition to the solid fuel, which forms the main feed material for the process, additional fuel in dust form may be fed to the reaction compartment. This may happen in any of the three gasification beds. Such additional fuel is fed into the process in particular together with the gasification media. The fuel in dust form may for example be coal dust deriving from other operations, or dusty material deriving from the process itself and separated for example in a cyclone. The aforegoing also applies to the feeding of additional liquid and/or gaseous fuels.

The process according to the invention may be satisfactorily operated with continuous fuel feed to the process. However, it is also possible and can in certain cases be desirable for the fuel feed to the process to be totally or partly discontinuous. This applies both for the fuel used as main feed material and for the additional fuel fed thereto.

The process may be carried out at normal pressure or particularly at superatmospheric pressure in the reaction compartment. This would depend inter alia on the requirements for the product gas.

An advantageous device for carrying out the process contains a generator vessel surrounding the reaction compartment and comprising a feed device for the fuel and connections for the media to be fed and withdrawn; the vessel is formed in its lower part as a fixed bed gasification zone with at least one feed line for the gasification media, and with a portion situated thereover in the form of a fluidised bed gasification zone with at least one feed line for the gasification and/or fluidisation media. In addition a dust gasification zone is provided above the fluidised bed gasification zone.

The fixed bed gasification zone is desirably in the form of a shaft and may in particular be constructed to resemble a revolving grate producer or slagging gas producer. It may be provided with a cooling jacket or the like, this being particularly desirable in the case of pressurised gasification.

It may also be desirable to provide a cooling jacket or the like in at least one part of the dust gasification zone, which is advantageously connected to a waste heat boiler or the like. The gas from the total process gives up sensible heat to this cooling device.

Corresponding inlets, nozzles or the like are provided on the vessel for feeding endothermic and exothermic gasification media into the process, the number of inlets being determined inter alia by the size of the reactor. In an advantageous embodiment, the inlets to the same gasification zone are disposed at different heights. This is particularly valid in the case of the fluidised bed gasification zone and dust gasification zone, but may also be advantageous in the case of the fixed bed gasification zone. Where there are several nozzles, inlets or the like, these desirably derive from a pipe ring surrounding the vessel.

Figure 2:
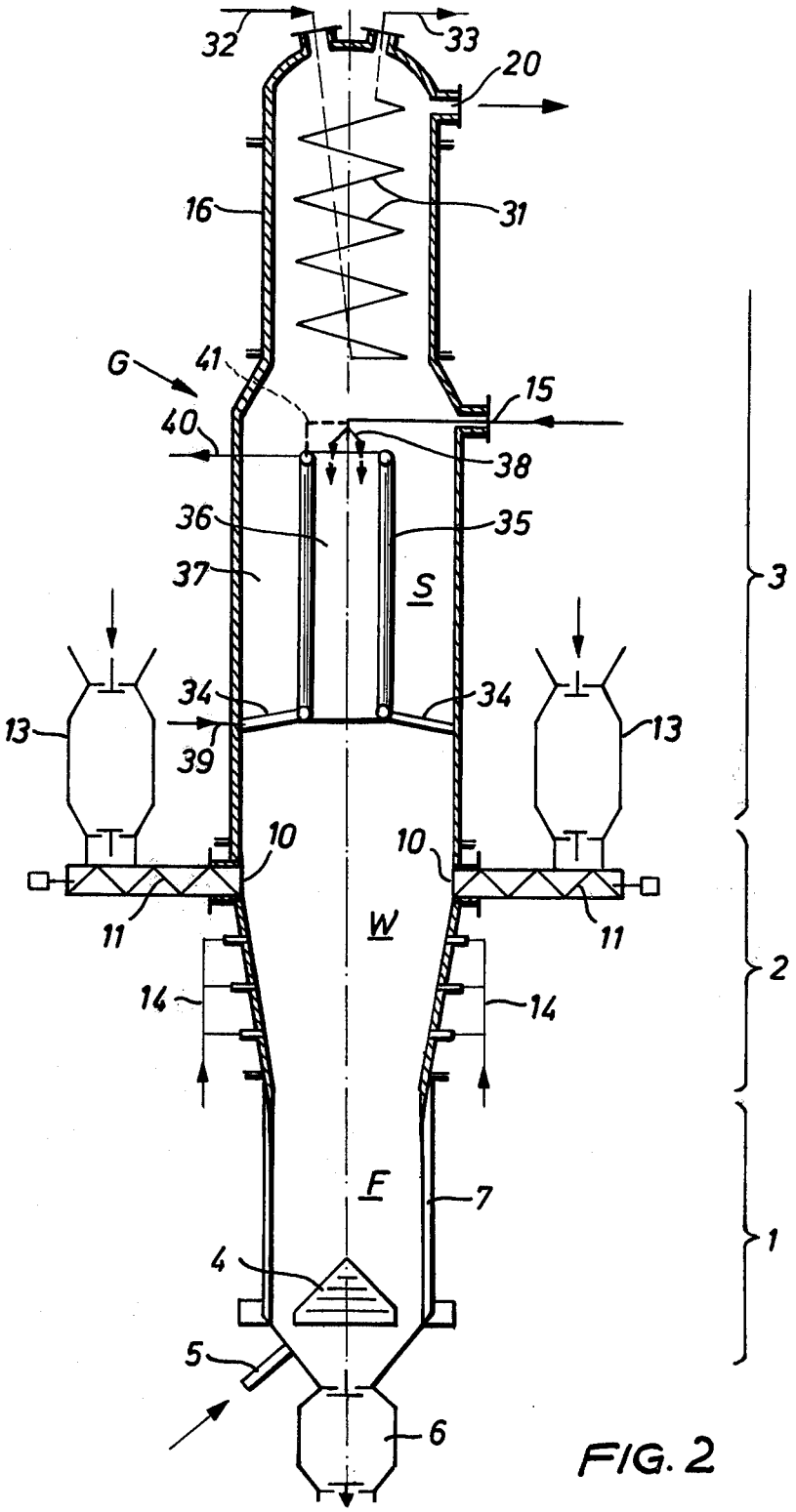

Further details, characteristics and advantages of the invention will be evident from the description given hereinafter, from the drawings and the claims. In the drawings:

FIG. 1 is a partly diagrammatic vertical longitudinal section through one example of a device according to the invention, and FIG. 2 is a partly diagrammatic vertical section through a further embodiment of a device according to the invention.

The device shown in FIG. 1 comprises a producer vessel G surrounding the total reaction compartment R, and comprising in its lower part 1 a fixed bed gasification zone F, in a part 2 lying thereover a fluidised bed zone W and in its upper part 3 a dust gasification zone S.

The fixed bed gasification zone F for gasifying the fuel in a stationary or quasi stationary bed is in the form of a shaft and is fitted with a revolving grate 4, which may be of known construction. The reference numeral 5 indicates a feed pipe opening into the revolving grate for the gasification media (e.g. air or oxygen and/or steam, according to the process to be carried out and/or the required gas). A lock 6 of known type serves for discharging the gasification residues from the fixed bed gasification zone F.

As a modification to the illustrated embodiment, the lower part 1 of the vessel G may be in the form of a slagging gas producer or any other suitable form for gasification in a stationary bed.

The lower vessel part 1 is provided over part of its height with a water jacket 7, connected by pipes 8 and 9 to a waste heat recovery system of known type, not shown.

An inlet 10 for the fuel is provided in the fluidised bed gasification zone W which follows the fixed bed gasification zone F. A fuel feed device comprises a drivable screw conveyor 11 and is disposed at the lower end of a holding tank 12 for fuel. This latter is provided upperly with a lock 13 of known type. Instead of a screw conveyor, a different device may be provided for feeding the fuel, e.g. a chute, a vibration conveyor or the like. The fuel can be fed continuously or discontinuously.

Below the fuel inlet 10 there are several feed pipes 14 distributed in the form of a ring around the circumference for the gasification medium (e.g. air, oxygen, steam). The inlets opening into the zone W then lie at different heights, as shown in the drawing. This part 2 of the vessel G containing the fluidised bed gasification zone W has an inner cross-section which widens upwards, and is in particular conical. The shape and the upper and lower end cross-sections of this part 2 are so chosen that granular fuel of a given particle size distribution is kept in a fluidised state by the action of the fed gasification medium and the gas rising from the fixed bed gasification zone F.

The reference numeral 15 indicates feed pipes or nozzles for the gasification medium which open into the dust gasification zone S, and are disposed in the form of nozzle rings at different heights.

In an appendage 16 of the vessel G at the top of the dust gasification zone S there is provided a cooling jacket 17, connected by pipes 18 and 19 to a waste heat recovery system. All the gas produced in the vessel G is led off from this upper appendage 16, shown shortened in the drawing, via a pipe 20. The cooling jacket may extend even further down, as shown by the dashed line 17'.

The vessel G is closed and is so constructed that gas production may be carried out under elevated internal pressure. However, it can also be carried out at normal pressure. If this latter is the case, then the locks 6 and 13 may be dispensed with, or be replaced by other devices as required.

One embodiment of the process according to the invention using a device of the described type is illustrated in detail hereinafter.

Coal in the form of lumps, granules and dust is fed from the store 12 by the feed device 11 into the fluidised bed zone W through the inlet 10. The portion unsuitable for fluidisation, i.e., the lumpy portion of the coal falls downwards into the shaft of the fixed bed zone F, where this portion is gasified in counter current with the gasification media injected under the revolving grate 4 through the feed pipe 5. The extent of gasification in the fixed bed depends on the proportion of lumpy coal in the total fuel. The reaction in the fixed bed is influenced in the required manner and kept under control by adjusting the relative quantities and mixture ratio of gasification media.

The granular portion of the fuel fed directly into the incandescent fluidised bed zone W is gasified therein, while the dust portion of the fuel rises into the dust gasification zone S above the fluidised bed zone W, and is gasified there.

The gasification and degasification products generated in the fixed bed zone F reach the fluidised bed and act as a fluidisation and gasification medium together with the gasification media fed from the outside directly into the fluidised bed W through the side nozzles or feed pipes 14. Any low temperature carbonisation products present are cracked in the incandescent fluidised bed, which inter alia also considerably simplifies gas cleaning.

A further advantage is that caking coal can be gasified without the usual difficulties occurring, because as the coal passes through the fluidised bed it ages and is made lean.

In addition to solid fuels, which form the main feed material for the process, gaseous and liquid or dusty fuels, or inert solid materials may be fed additionally into the gasification vessel, in which case suitable feed pipes, nozzles or the like are provided in the vessel G at suitable places.

In the illustrated embodiment, the reference numeral 21 indicates a feed pipe opening into the fixed bed gasification zone F, through which in addition to the main feed fuel for the process which enters the producer through the inlet 10, further fuels, e.g., coal dust, may be fed, in particular together with a gasification medium. Several such feed pipes may be provided.

Additional fuel, whether in gaseous, liquid, dust or other form, may also be fed into the fluidised bed gasification zone W or especially into the dust gasification zone S, for example through some or all of the feed pipes 14, 15.

The gasification residues from the fixed bed zone F are removed together with gasification residues from the fluidised bed zone W at the lower end of the vessel G through the lock 6 or another suitable device.

The process may be influenced in the required manner by the type of gasification medium (e.g., air, oxygen, $CO_2$, steam) and its relative quantity and mixture ratio. By this means either fuel gas or synthesis gas may be produced.

The following chemical reactions with their associated thermal effects occur in the overall process, these reactions taking place successively in the stationary gasification bed and more separated spacially therein than in the overlying fluidised bed and dust gasification zones:

| | |
|---|---|
| $C + 02 = CO_2$ | (combustion of C to $CO_2$) |
| $C + 0 = CO$ | (combustion of C to CO) |
| $C + CO_2 = 2\ CO$ | (reduction of $CO_2$) |
| $C + H_2O = CO + H_2$ | (water gas formation) |
| $CO + H_2O = CO_2 + H_2$ | (water gas equilibrium) |

PRACTICAL EXAMPLE

Coal having a particle size of 0 to 60 mm is continuously fed into the fluidised bed zone W of a producer vessel having a shaft cross section of about 8.5 $m^2$ and a height of 27 m.

| | |
|---|---|
| Screen analysis of the coal: | < 1 mm = 15% |
| | 1 - 4 mm = 30% |
| | 4 - 8 mm = 15% |
| | > 8 mm = 40% |
| Coal composition: | Water = 4.11% |
| | Ash = 12.48% |
| | Volatile substance = 38.16% |
| | $C_{fix}$ = 45.25% |
| Lower calorific value of the coal: LCV = 6400 Kcal/kg | |
| Gas production (under pressureless operation): > 20,000 $Nm^3/h$ => 2350 $Nm^3/m^2$ of shaft. | |
| Composition of product gas: | $CO_2$ = 14.8% |
| | CO = 41.0% |
| | $H_2$ = 39.0% |
| | $CH_4$ = 2.0% |
| | $N_2$ = 2.0% |
| | $H_2S$ = 1.2% |
| Consumption: $O_2$ : 5120 $m^3/h$, steam: 3570 kg/h, coal: 10,000 kg/h | |
| Gasification in fixed bed (F): 420 $m^3/h$ $O_2$, 1270 kg/h steam | |
| Gasification in fluidised bed (W): 3500 $m^3/$ $O_2$, 2000 kg/h steam | |
| Gasification in dust gasification region (S): 1200 $m^3/h$ $O_2$, 300 kg/h steam | |
| Measured temperature in zone F: 900° C (higher locally) | |
| Measured temperature in zone W: 950° C (higher locally) | |
| Measured temperature in zone S: 1050° C (higher locally) | |
| Gasification efficiency: $\frac{LCV\ (gas)}{LCV\ (coal)} = 71\%$ | |
| Thermal efficiency: $\frac{LCV\ (gas) + LCV\ (waste\ heat\ steam)}{LVC\ (coal)} = 81\%$ | |

By increasing the temperature in the fluidised bed zone W and/or in the dust gasification zone S, the $CO_2$ content can be considerably reduced, and likewise by preheating the gasification medium. For this reason it is desirable to increase the cooling region in the top of the vessel G.

In FIG. 2, parts which are analogous to those of the embodiment of FIG. 1 or which serve the same purpose are indicated with the same reference numeral. That which has been stated with reference to these parts and with reference to the operation of the process of FIG. 1 is valid also for the embodiment of FIG. 2.

The device shown in FIG. 2 again includes a producer vessel G comprising a fixed bed gasification zone F in its lower part 1, a fluidised bed gasification zone W in the overlying part 2 and a dust gasification zone S in the part 3. FIG. 2 also shows a revolving grate 4, a feed pipe 5 for gasification media, an ash lock 6, a cooling jacket 7, feed pipes 14 for gasification and/or fluidisation media to the zone W and, in this particular embodiment, fuel inlets 10 disposed in two opposing positions with associated conveyor or feed devices 11 and connected locks 13, into which coal is fed in the direction of the arrows.

The part 3 surrounding the dust gasification zone S continues in the form of an upper appendage 16 of somewhat smaller diameter. An outlet 20 for the product gas generated in the producer G extends from the top of the appendage 16. In the appendage 16 there is also a heat exchanger or steam superheater 31 formed from pipe coils or the like, comprising a steam inlet 32 and steam outlet 33, and by which the product gas flowing to the outlet 20 is cooled. The steam leaving the superheater 31 may be used in further units of the overall gas production plant or be used externally.

An assembly 35 in the form of a shaft or pipe is supported in the dust gasification zone S of the vessel G by bars 34 or the like, and is disposed so as to comprise a central inner passage 36 and an outer passage 37, this latter for example having a circular cross-section. In the region of the upper end of the assembly 35 there is provided a system of nozzles 38 to which a gaseous medium is fed through a pipe, for instance a pipe 15 deriving from the outside, the nozzle openings being disposed pointing downwards into the interior 36 of the assembly 35, so that they operate in the manner of an injector.

The medium feeding the nozzles 38 is normally gasification media, in particular oxygen and/or steam. It may however be advantageous to feed another gas, such as product gas, through the nozzles into the producer, together with particles separated in a cyclone or the like.

In addition to a feed pipe for the nozzles 38, feed pipes for gasification media may also be provided in the region of zone S, opening directly therein.

The assembly 35 is desirably provided with a cooling system. It may for example be in the form of a cooling jacket. Water, for example, may then be fed from below through a pipe 39 to leave the assembly 35 at the top through a pipe 40, for example in the form of steam. The feed pipe for the cooling medium desirably passes through a bar 34 or actually forms part of this latter. All the bars could be in the form of pipes for the cooling medium, and thus be self-cooled.

It can also be advantageous to use the medium fed to the nozzles 38 in the aforesaid manner, for example product gas, as the cooling medium for the assembly 35, the medium being fed through the pipe 39 or several such pipes into the cooling mantle or cooling system for the assembly 35, and then being fed from the upper end thereof through a connection pipe 41 shown in FIG. 2 by a dashed line, to the nozzles 38.

By means of the injection of gasification media and/or another gas through the nozzles 38, a recycle flow is set up in the dust gasification zone S of the material for gasification present in this zone, so that material from the top of zone S is led downwards through the interior 36 of the assembly 35, and after leaving the assembly 35 it again flows upwards in the outer space 37. In this manner, an advantageous increase in the residence time of the material in this zone is attained. This gives inter alia the advantage that the gasification of dust particles containing carbon is intensified and complete cracking of any volatile components which may not have been gasified in the other zones is attained. Furthermore, dust particles from the top of zone S are again dragged into the fluidised bed zone W through the interior 36 of the assembly 35 by the action of the medium injected through the nozzles 38, so that these particles agglomerate with other particles to form heavy particles, and as such are able to deposit. They are thus not present in the product gas withdrawn.

The method of operation of the producer shown in FIG. 2 may generally correspond to that for the embodiment shown in FIG. 1.

All characteristics mentioned in the description or illustrated in the drawing fall within the scope of the invention either alone or in combination, as far as the state of the art allows.

I claim:

1. A single, overall process for producing gas from a solid fuel containing portions thereof in the form of lumps, granules, and dust, in a reaction compartment provided with a fixed bed gasification zone, a fluidized bed gasification zone positioned above the fixed bed gasification zone, and a dust gasification zone positioned above the said fluidized bed gasification zone, all of said zones communicating with each other, said reaction compartment being also provided with means for injecting a gaseous medium for gasifying said fuel portions in each of said zones, said process comprising feeding said solid fuel into the fluidized bed gasification zone while simultaneously injecting a gasification medium into each of said zones, whereupon (a) the lumpy portion of the fuel falls into the fixed bed gasification zone and is partly gasified when the lumpy portion moves counter-current to the medium injected into the fixed bed gasification zone, and the formed gases along with the carbonization products, are carried into the fluidized bed gasification zone; (b) the granular portion of the fuel is partly gasified in the fluidized bed gasification zone by the gasification medium injected therein, while the carbonization products carried along from the fixed bed gasification zone are cracked in said fluidized bed gasification zone; and (c) the dust portion rises into the dust gasification zone and is partly gasified by the gasification medium injected into this zone which gasification medium includes oxygen.

2. The process of claim 1 wherein the solid fuel is coal having particles of a size ranging from less than 1mm to 60mm.

3. A process as claimed in claim 1, wherein a recycle movement is impressed on the gasification material in the dust gasification zone by injecting the gaseous medium into this zone.

4. A process as claimed in claim 1, wherein, in addition to the solid fuels which form the main feed material, liquid and/or gaseous fuels are fed to the reaction compartment.

5. A process as claimed in claim 1, wherein, in addition to the solid fuels which form the main feed material, additional solid fuel in the form of dust is fed to the reaction compartment.

6. A process as claimed in claim 4, wherein, the additional fuels are fed to the reaction compartment together with gasification media.

7. A process as claimed in claim 1, wherein the fuel feed to the reaction compartment is continuous.

8. A process as claimed in claim 1, wherein the fuel feed to the reaction compartment is at least partly discontinuous.

9. A process as claimed in claim 1, wherein the gasification takes place under superatmospheric pressure.

* * * * *